United States Patent [19]

Sagawa

[11] 4,244,073

[45] Jan. 13, 1981

[54] PIPELINE PIG

[76] Inventor: Sizuo Sagawa, 12-8, 1-chome, Minami-Kugahara, Ohta-ku, Tokyo, Japan

[21] Appl. No.: 30,907

[22] Filed: Apr. 17, 1979

[51] Int. Cl.[3] ..... B08B 9/04

[52] U.S. Cl. ..... 15/104.06 A

[58] Field of Search ..... 15/104.06 R, 104.06 A; 134/8

[56] References Cited

U.S. PATENT DOCUMENTS

| | | | |
|---|---|---|---|
| 3,543,323 | 12/1970 | Girard | 15/104.06 R |
| 4,016,620 | 4/1977 | Powers | 15/104.06 R |
| 4,077,079 | 3/1978 | Knapp | 15/104.06 R |

FOREIGN PATENT DOCUMENTS

| | | | |
|---|---|---|---|
| 278318 | 3/1970 | U.S.S.R. | 15/104.06 R |

*Primary Examiner*—Edward L. Roberts

*Attorney, Agent, or Firm*—Finnegan, Henderson, Farabow, Garrett & Dunner

[57] ABSTRACT

A pipeline pig including a generally cylindrically shaped body formed of an elastic material, the body having a diameter larger than the internal diameter of a pipeline into which the pig is to be thrusted, and a conical portion provided at the forward end of the body, the pig comprising a plurality of spaced pin shaped metal members provided on the peripheral surface of the body, each of the pins including a heat portion protruding outwardly from the body, a shaft portion radially embedded in the body and an anchoring portion provided at the inner end of the pin, and the pins being made of a material not as hard as that of the pipeline and somewhat harder than that of the substance to be removed or scraped by the pig from the pipeline.

6 Claims, 5 Drawing Figures

PIPELINE PIG

BACKGROUND OF THE INVENTION

This invention relates to a pipeline pig drivable under pressure through a pipeline for removing or scraping scales, slags and the like from the internal wall of the pipeline.

A conventional pipeline pig for such a purpose includes a generally cylindrically shaped body formed of a resilient material, the body having a diameter larger than the internal diameter of the pipeline into which the pig is to be thrusted, and a conical portion provided at the forward end of the body. However, such a pig is disadvantageous in that the scales, slags or the like can not be fully removed or scraped from the internal wall of the pipeline, that the scales are scraped in relatively large masses so that a relatively high fluid pressure has to be applied to the rearward end of the pig for propelling same, and that the pig may be jammed in the pipeline.

An object of the present invention is to provide a pipeline pig in which such drawbacks are absent.

It is another object of the invention to provide a pipeline pig in a simple and convenient form.

According to the present invention, there is provided a pipeline pig including a generally cylindrically shaped body formed of an elastic material, said body having a diameter larger than the internal diameter of the pipeline into which said pig is to be thrusted, and a conical portion provided at the forward end of said body, said pig comprising a plurality of spaced pin-like members provided on the peripheral surface of said body, each of said pins including a head portion provided outwardly from said body, a shaft portion radially embedded in said body and an anchoring portion provided at an inner end of said pin, and said pins being made of a material not as hard as that of said pipeline and somewhat harder than that of a substance to be removed or scraped by said pig from said pipeline.

DESCRIPTION OF THE PREFERRED EMBODIMENT

Figure 1:
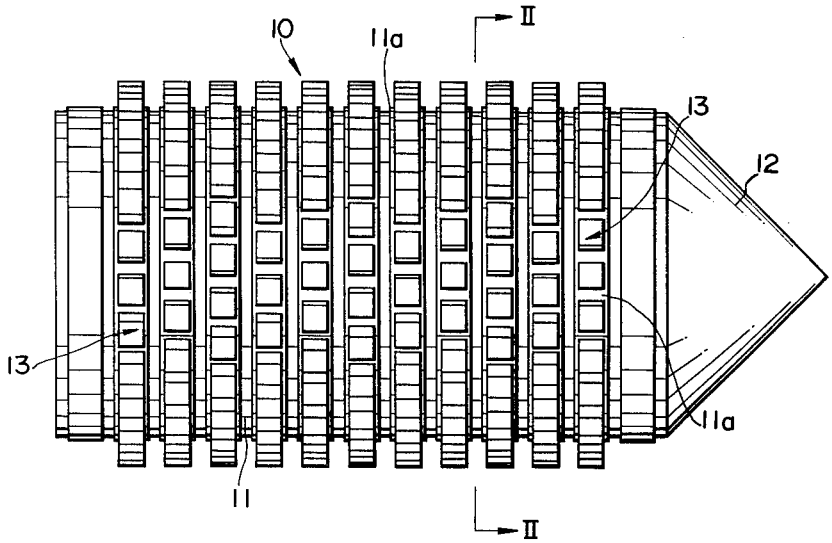
FIG. 1 is a side view of a preferred embodiment of a pipeline pig in accordance with the present invention.

Referring first to FIG. 1, a pipeline pig according to the present invention is generally designated by 10 and comprises a generally cylindrically shaped body 11, formed of an elastic material, such as foamed polyurethane, which has at its forward end an integral conical portion 12. The body 11 is of somewhat larger diameter than the internal diameter of a pipe into which the pig is to be thrusted. It is further important that the material of the pig body 11 has a hardness ranging between about 50 and 100, preferably between about 85 and 95, when measured by a rubber hardness tester. The entire surface of the pig is treated by a suitable process so that no fluid is able to penetrate the pig.

The pig 10 is further provided with a plurality of pin shaped metal members 13 on the periphery of the body 11. The pins 13 are disposed in a plurality of axially spaced, circumferential rows.

Figure 2:
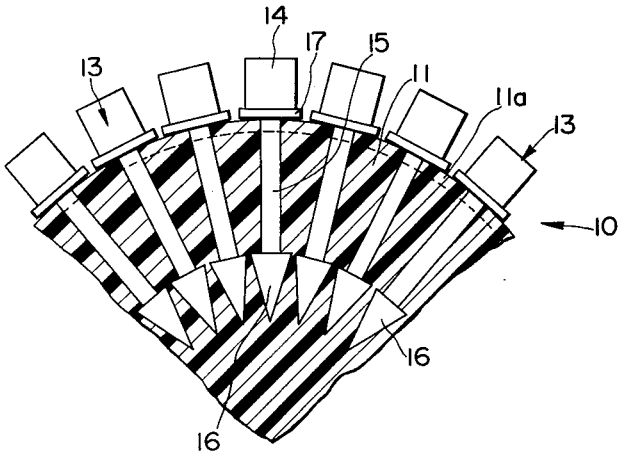
FIG. 2 is a fragmentary sectional view taken along a line II—II shown in FIG. 1.
Figure 3:
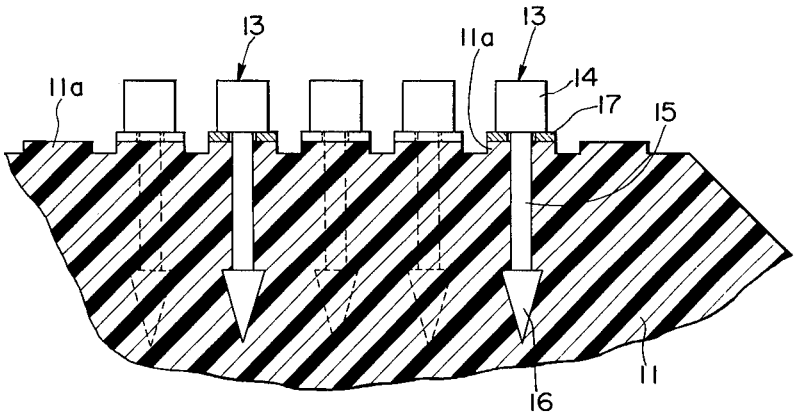
FIG. 3 is a fragmentary longitudinal section of a part of the pig of FIG. 1.

As shown in FIG. 2, each of the pins 13 includes a square head portion 14 protruding outwardly from the body 11 of the pig 10, a shaft portion 15 radially embedded in the body 11 and an anchoring portion 16 provided at an inner end of the pin 13 for preventing the latter from being removed from the body 11. Washers 17 may be interposed between the body 11 and the head portions 14 of the respective pins 13.

The pins 13 are made of a metallic material not as hard as that of the pipe to be cleaned and somewhat harder than that of the scales, slags and the like to be removed or scraped by the pig from the pipe. For example, the pins for a pig for cleaning a heating pipe of a petroleum refining facility are made of an iron material having a Brinell hardness of about 150–160, since the scales and slags formed in and affixed to such a pipe are composed of a mixture of 92% of iron sulfide and 8% of carbon having a Brinell hardness of approximately 140.

The circumferential rows of the pins 13 are in zigzag disposition relative to one another so that the square head portion 14 of each of the pins 13 of such a row is axially overlapped in part with the square head portions 14 of adjacent pins 13 of the subsequent circumferential row, as will be seen in FIG. 1. It is preferable that the areas of the head portion 14 of a pin 13 axially overlapped with the head portions of the axially rearward pins 13 are approximately $\frac{1}{3}$ to $\frac{1}{2}$ of the whole area of the head portion 14. In a typical pig suitable for use for cleaning a pipe having a diameter of about 150–200 milli-meters, the square head portion 14 of each of the pins 13 has dimensions of 5 milli-meters in height, 5 milli-meters in length and 5 milli-meters in width, and the axial distance between the head portions of the adjacent pins 13 is about 5–10 milli-meters.

Figure 4:
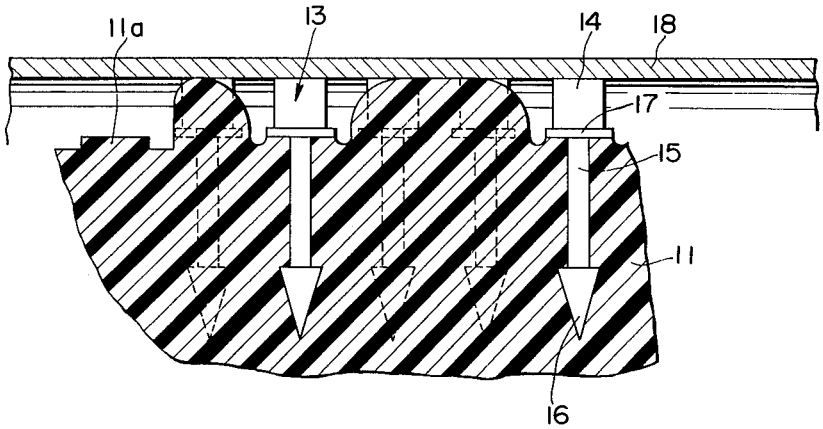
FIG. 4 is a similar view to FIG. 3 but showing the pig inserted in a pipeline.

In use, the pig 10 is thrusted by suitable means into a pipeline 18 to be cleaned and thus is deformed as shown in FIG. 4. When the pig 10 is propelled through the pipeline 18 by a higher pressure acting on the rearward end surface of the pig, the square head portions 14 of the pins 13 are rubbed against the internal surface of the pipeline 18 to scrape away the scales and slags therefrom. The scraped scales and slags are crushed by the spaced square head portions 14 of the pins 13 into relatively small masses, so that there is no serious resistance against the advance movement of the pig.

It will be understood that when the pig has been thrusted into the pipeline as shown in FIG. 4, a plurality of wrinkles is caused on the peripheral surface of the body 11 of the pig 10 to form extremely small passages between the body 11 and the pipeline 18 from the rearward end of the body to the forward end thereof for injecting under pressure the fluid on the rearward end of the body into the interior of the pipeline in front of the pig. The jet streams of the fluid so generated will urge the relatively small masses of the scales and slags forwardly of the pig to reduce the resistance acting thereon.

It is further noted that the provision of the spaced pins 13 permits the pig to be driven in a curved pipe or bend having a relatively large curvature.

Figure 5:
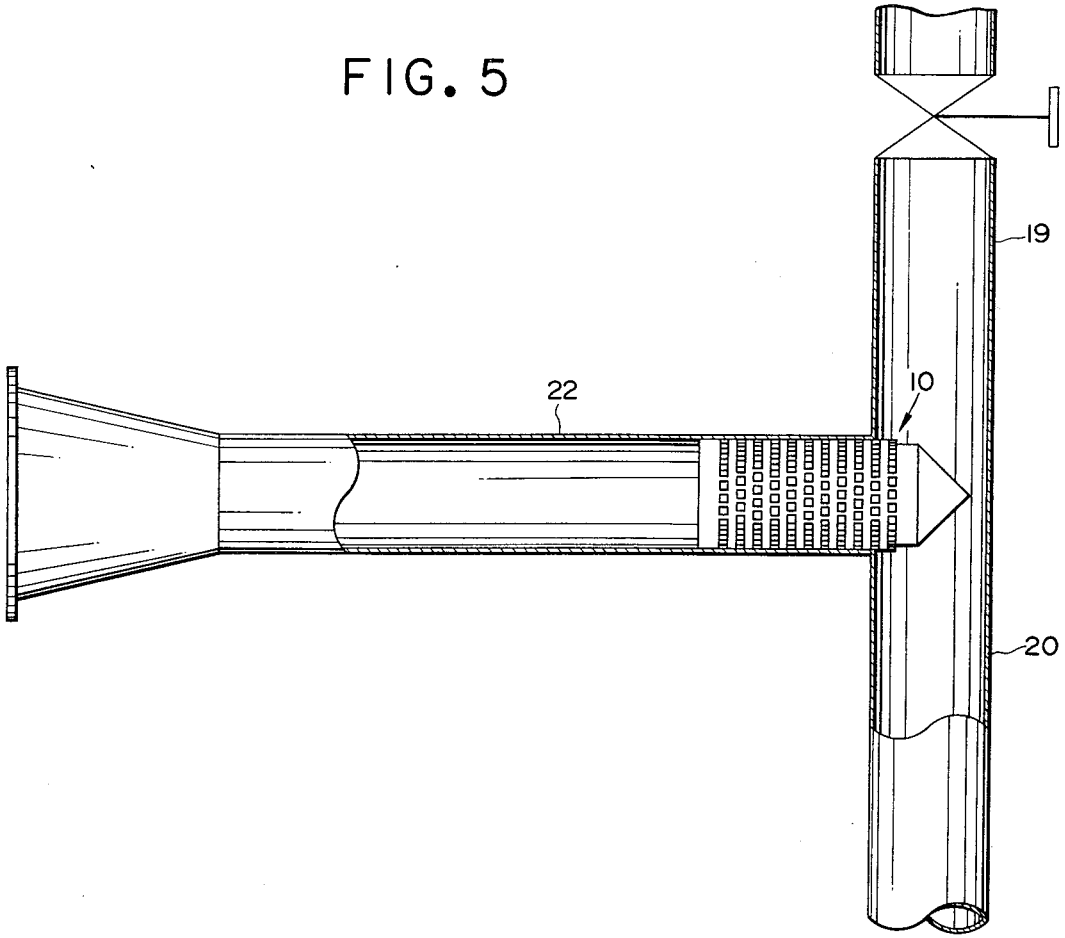
FIG. 5 is a schematic view showing the pig passing through a T-shaped pipe connection.

In the event that the pig is moved to such a T-shaped pipe connection as is shown in FIG. 5, the conical forward end portion 12 abuts against the internal surface of the T-shaped connection thereby isolating the interior of a branch pipe 19 from that of a branch pipe 20. When it is intended to drive the pig 10 through the branch pipe 20, a valve 21 provided in the branch pipe 19 is closed and the interior of the branch pipe 20 is released. The fluid in a branch pipe 22 of the T-shaped connection flows through the above-described passages on the peripheral surface of the pig into the branch pipes 19 and 20 so that the pressure in the branch pipe 19 is gradually increased, but no increase in pressure within the branch pipe 20 is caused. In so doing, the increased fluid pressure in the branch pipe 19 acts on the pig to bend the forward portion thereof towards the branch pipe 20 and thus the pig can pass through the T-shaped connection to enter into the branch pipe 20.

It is preferred to form a plurality of pin seating portions 11*a* on the external surface of the body 11.

With the arrangement described above, the pig of the present invention can completely scrape the scales and slags in a pipeline without stopping therein and is available even in a relatively large curvature of piping, in a relatively large diameter of a pipe, such as up to several meters in diameter and in a relatively long pipeline, such as several hundreds kilo-meters in length as in the case of a petroleum conveying pipeline.

What is claimed is:

1. A pipeline pig including a generally cylindrically shaped body formed of an elastic material, said body having a diameter larger than the internal diameter of a pipeline into which said pig is to be thrusted, and a conical portion provided at the forward end of said body, said pig comprising a plurality of spaced pin-like members provided on the peripheral surface of said body, each of said pins including a head portion provided outwardly from said body, a shaft portion radially embedded in said body and an anchoring portion provided at an inner end of said pin, and said pins being made of a material not as hard as that of said pipeline and somewhat harder than that of the substance to be removed or scraped by said pig from said pipeline, said pins being disposed in a plurality of axially spaced, zigzag, circumferential rows such that said head portions of said pins are axially overlapped in part with those of said pins of adjacent rows, the areas of said head portion of each of said pins axially overlapped with the head portions of the adjacent pins being approximately $\frac{1}{3}$ to $\frac{1}{2}$ of the whole area of said head portion.

2. A pipeline pig according to claim 1 in which said pins are made of a metallic material.

3. A pipeline pig according to any of claims 1 or 2 in which said head portion of each of said pins is of a square-shaped configuration.

4. A pipeline pig according to any of claims 1 or 2 which further comprises washers interposed between said body and said head portions of the respective pins.

5. A pipeline pig including a generally cylindrical shaped body formed of an elastic material, a plurality of spaced pins carried by said body, said pins being separate from one another and each including a shaft portion radially embedded in said body, an enlarged anchoring portion at the inner end of each said pin and preventing withdrawal of said pins from said body, and an enlarged head at the outer end of each said pin and outwardly of said body, said body being formed with raised pin seating portions on its periphery through which said pins pass.

6. A pipeline pig according to claim 5 wherein a washer is provided on each said pin adjacent the head thereof and is adapted to seat against a respective one of said pin seating portions.

* * * * *